US008292399B2

(12) United States Patent
Burke

(10) Patent No.: US 8,292,399 B2
(45) **Date of Patent: *Oct. 23, 2012**

(54) PROVIDING UNIFORM ILLUMINATION TO A MOVING SENSOR

(75) Inventor: Gregory M. Burke, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 255 days.

This patent is subject to a terminal disclaimer.

(21) Appl. No.: 12/826,722

(22) Filed: Jun. 30, 2010

(65) Prior Publication Data

US 2012/0001977 A1 Jan. 5, 2012

(51) Int. Cl.
*B41J 29/393* (2006.01)

(52) U.S. Cl. ..... 347/19; 347/14

(58) Field of Classification Search ..... 347/14, 347/16, 19, 101, 105, 106, 107
See application file for complete search history.

(56) References Cited

U.S. PATENT DOCUMENTS

| | | | | |
|---|---|---|---|---|
| 6,914,684 | B1 * | 7/2005 | Bolash et al. | 347/105 |
| 6,960,777 | B2 | 11/2005 | Soar | |
| 7,015,474 | B2 | 3/2006 | Martenson | |
| 7,120,272 | B2 | 10/2006 | Guiguizian | |
| 2006/0044577 | A1 | 3/2006 | Weast et al. | |
| 2009/0231403 | A1 | 9/2009 | Shi et al. | |
| 2010/0149246 | A1 | 6/2010 | Pawlik | |

* cited by examiner

*Primary Examiner* — Juanita D Jackson
(74) *Attorney, Agent, or Firm* — Peyton C. Watkins

(57) ABSTRACT

A method for providing uniform or substantially uniform illumination to a field of view of a light sensing device that is moving with respect to a light source, the method comprises the steps of (a) providing an inkjet printhead to eject ink for printing; (b) providing a monitor to track the position of the light sensing device relative to the light source; and (c) providing an energy supply that provides a time-varying energy as a function of the position of the light sensing device relative to the light source in a manner that provides substantially uniform illumination from the light source toward a field of view of the light sensing device.

24 Claims, 12 Drawing Sheets

PROVIDING UNIFORM ILLUMINATION TO A MOVING SENSOR

CROSS REFERENCE TO RELATED APPLICATIONS

Reference is made to commonly assigned U.S. patent application Ser. No. 12/826,724 filed Jun. 30, 2010 by Greg M. Burke, entitled "Printer with Uniform Illumination for Media Identification".

FIELD OF THE INVENTION

The present invention generally relates to a method of providing uniform illumination to a moving light sensing device from a light source having a spatially nonuniform field of illumination, and more particularly to a method of providing uniform illumination for detecting the type of print media being used in a printer.

BACKGROUND OF THE INVENTION

In a carriage printer, such as an inkjet carriage printer, a printhead is mounted in a carriage that is moved back and forth across the region of printing. To print an image on a sheet of paper (sometimes generically referred to as print medium or recording medium herein), the paper is advanced a given nominal distance along a media advance direction and then stopped. Paper advance is typically done by a roller and the nominal distance is typically monitored indirectly by a rotary encoder. While the paper is stopped and supported on a platen, the printhead carriage is moved in a direction that is substantially perpendicular to the media advance direction as marks are controllably made by marking elements on the paper—for example by ejecting drops from an inkjet printhead. Position of the carriage and the printhead relative to the print medium is precisely monitored, typically using a linear encoder. After the carriage has printed a swath of the image while traversing the paper, the paper is advanced, the carriage direction of motion is reversed, and the image is formed swath by swath.

In order to produce high quality images, it is helpful to provide information to the printer controller electronics regarding the printing side of the recording medium, which can include whether it is a glossy or matte-finish paper. Such information can be used to select a print mode that will provide an optimal amount of ink in an optimal number of printing passes in order to provide a high quality image on the identified media type. It is well-known to provide identifying marks or indicia, such as a bar code, on a non-printing side of the recording medium to distinguish different types of recording media. It is also well known to use a sensor in the printer to scan the indicia and thereby identify the recording medium and provide that information to the printer control electronics. U.S. Pat. No. 7,120,272, for example, includes a sensor that makes sequential spatial measurements of a moving media that contains repeated indicia to determine a repeat frequency and repeat distance of the indicia. The repeat distance is then compared against known values to determine the type of media present.

Co-pending US Patent Application Publication 2009/0231403 discloses the use of a backside media sensor to read a manufacturer's code for identifying media type. In this approach light from a light source is reflected from the backside of the media and received in a photosensor while the print media is being advanced past the photosensor. A source of unreliability in interpreting the signals is that media can slip during advance past the photosensor.

Co-pending US Patent Application Publication 2010/0149246 discloses reflecting light from a surface such that the reflected light is sensed by a sensor. In this system, one of the optical components is mounted to a movable device. As in US Patent Application Publication 2009/0231403 described above, in order to detect a manufacturer's code for identifying media type, the light is reflected from the backside of the media. Such an approach is compatible with media travel paths in which the backside of the media is viewable. However, this is difficult in some other types of media travel paths, especially where the printing side of the media faces outward away from the stack of media throughout the entire travel path.

Identification of media type by using transmitted light to detect a manufacturer's code, such as a bar code, has been disclosed in US Patent Application Publication 2006/0044577. In this application, the media is advanced past a transmissive sensor assembly including a light source and a transmissive optical sensor. As in co-pending US Patent Application Publication 2009/0231403, a source of unreliability in interpreting the signals is that media can slip during advance past the optical sensor.

Other disclosed approaches use both reflection and transmission of light simultaneously in the same printer to detect the media type. For example, U.S. Pat. No. 6,960,777 B2 positions a first light source on one side of the media and a second light source on the opposite side of the media with a sensor also positioned on the second side. The sensor receives light transmitted through the media from the first light source, and reflected light from the second light source. A ratio of the received reflected and transmitted light is then used to determine the media type.

Another prior art system, U.S. Pat. No. 7,015,474 B2, also uses both reflection and transmission of light simultaneously. This system positions a light source and a first sensor on a first side of the media, and a second sensor is positioned on the second side. The first sensor receives reflected light and the second sensor receives transmitted light both of which are used to determine a characteristic of the media.

Although these prior art systems are satisfactory, they include drawbacks. For example, using a ratio of reflected light to transmitted light includes the drawback of not compensating for the degradation of devices over time which will cause the ratio to deviate from expected results. Furthermore, systems which rely on moving the media past a sensor in order to read a manufacturer's code can be adversely affected in detection of sizes or distances between features of a manufacture's code if the media slips relative to the roller whose rotation is monitored, for example, by a rotary encoder. In other words, the position of the media is only indirectly monitored. Although the position of the roller can be well known, the position of the media can vary in unexpected ways relative to the roller.

Co-pending U.S. patent applications (Ser. Nos. 12/604,428, 12/604,434 and 12/604,447) disclose overcoming these drawbacks by using a carriage-mounted sensor, whose position relative to the print medium is directly monitored, and by using light transmitted through the print media from a light source having a field of illumination that extends across the region where the manufacturer's code on the media will be located. As disclosed in those applications, although a single large light source can be used to provide illumination, one or more smaller light sources can be advantageous in that they can be compactly fit into the platen which supports the print medium in the region across which the carriage passes.

Because the light from a small light source falls off in intensity as it spreads out further from the light source, it can be advantageous to have a plurality of light sources. In order to reduce cost, it is desirable to have relatively few light sources. However, if the light sources are spread out at too large of a spacing, the composite field of illumination becomes spatially nonuniform to an extent that can compromise the reliability of reading manufacturer's codes accurately.

What is needed is a method of providing substantially uniform illumination to a field of view of a light sensing device that is moving with respect to a light source or light sources having a spatially nonuniform field of illumination.

SUMMARY OF THE INVENTION

The present invention is directed to overcoming one or more of the problems set forth above. Briefly summarized, according to one aspect of the invention, the invention resides in a method for providing uniform or substantially uniform illumination to a field of view of a light sensing device that is moving with respect to a light source, the method comprising the steps of (a) providing an inkjet printhead to eject ink for printing; (b) providing a monitor to track the position of the light sensing device relative to the light source; and (c) providing an energy supply that provides a time-varying energy as a function of the position of the light sensing device relative to the light source in a manner that provides substantially uniform illumination from the light source toward a field of view of the light sensing device.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1:
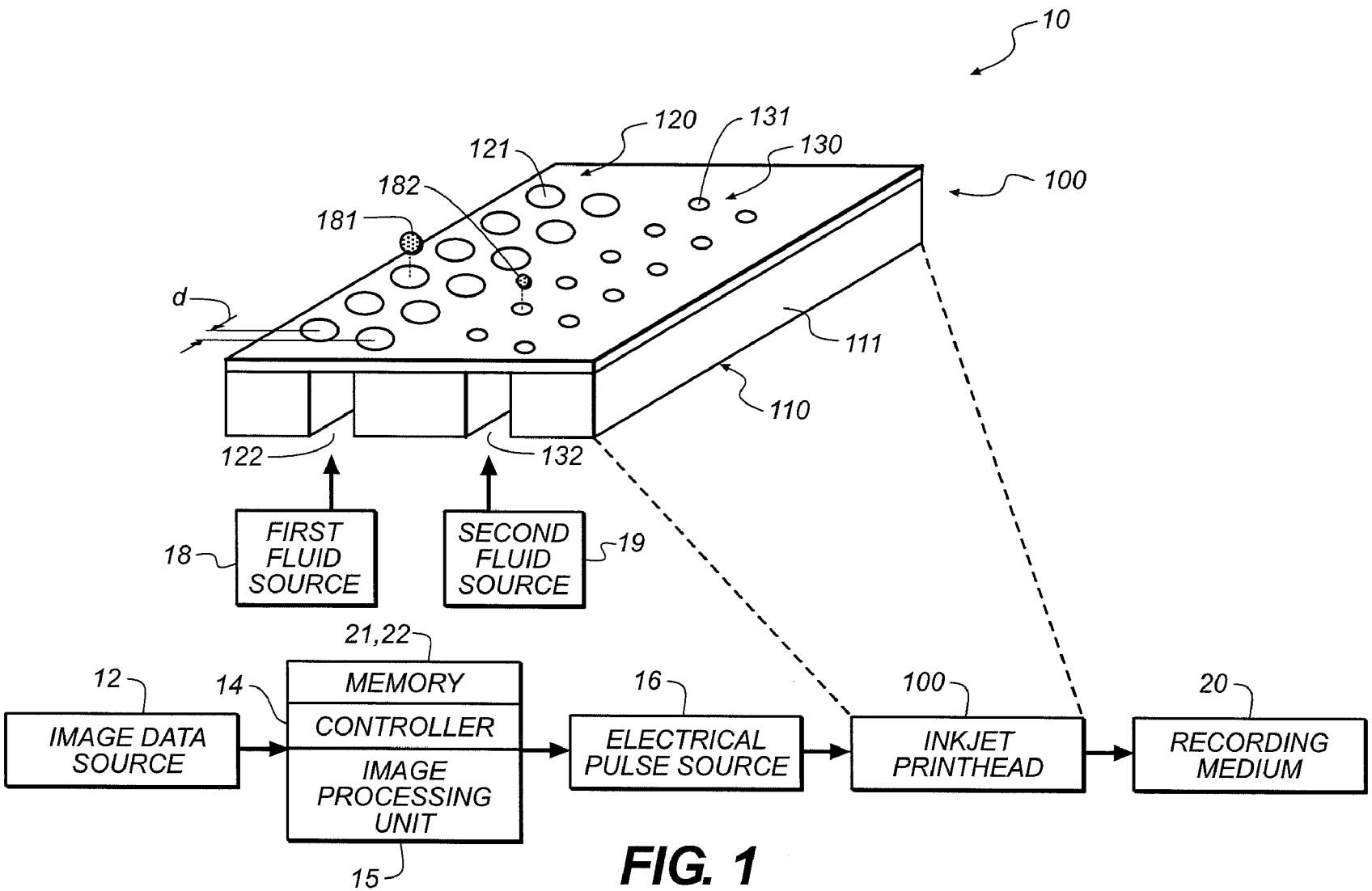
FIG. 1 schematically shows an inkjet printing system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110. The controller 14 also provides illumination control for light sources based on an energy profile stored in memory 21, as well as identification processing for comparing a signal pattern corresponding to a piece of media to stored signal patterns corresponding to known media types in memory 21, as will be discussed in detail herein below.

In the example shown in FIG. 1, there are two nozzle arrays 120 and 130 that are each disposed along a nozzle array direction 254. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a mounting support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132, respectively. Also, in some embodiments, fewer than two or more than two nozzle arrays can be included on inkjet printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
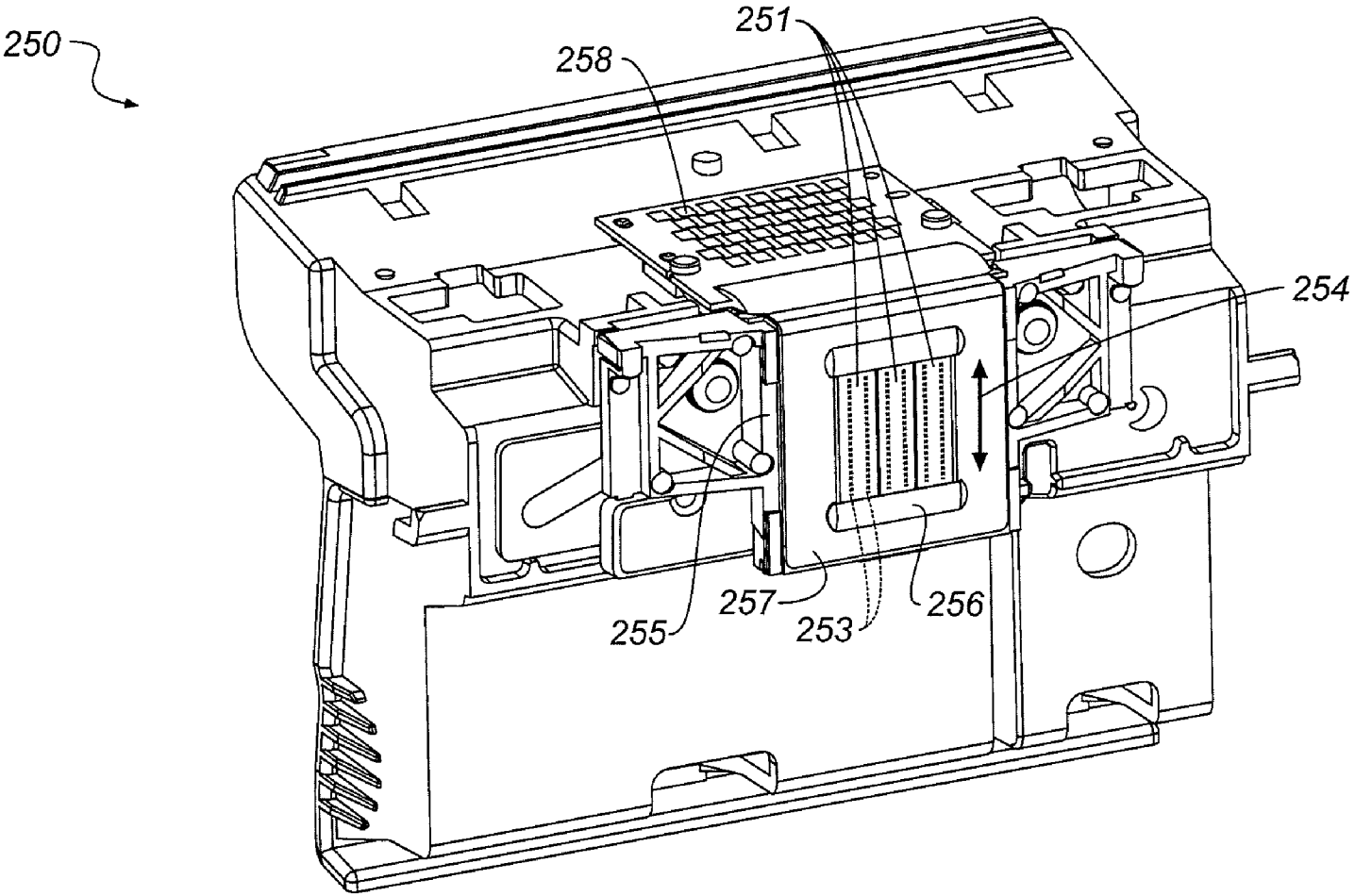
FIG. 2 is a perspective view of a printhead chassis.

FIG. 2 shows a perspective view of a portion of a printhead chassis 250, which is an example of an inkjet printhead 100. Printhead chassis 250 includes three printhead die 251 (similar to inkjet printhead die 110 of FIGS. 1 and 2) that are affixed to a common mounting support member 255. Each printhead die 251 contains two nozzle arrays 253, so that printhead chassis 250 contains six nozzle arrays 253 altogether. The six nozzle arrays 253 in this example can each be connected to separate ink sources. Each of the six nozzle arrays 253 is disposed along nozzle array direction 254, and the length of each nozzle array along nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals can be transmitted to the printhead die 251.

Figure 3:
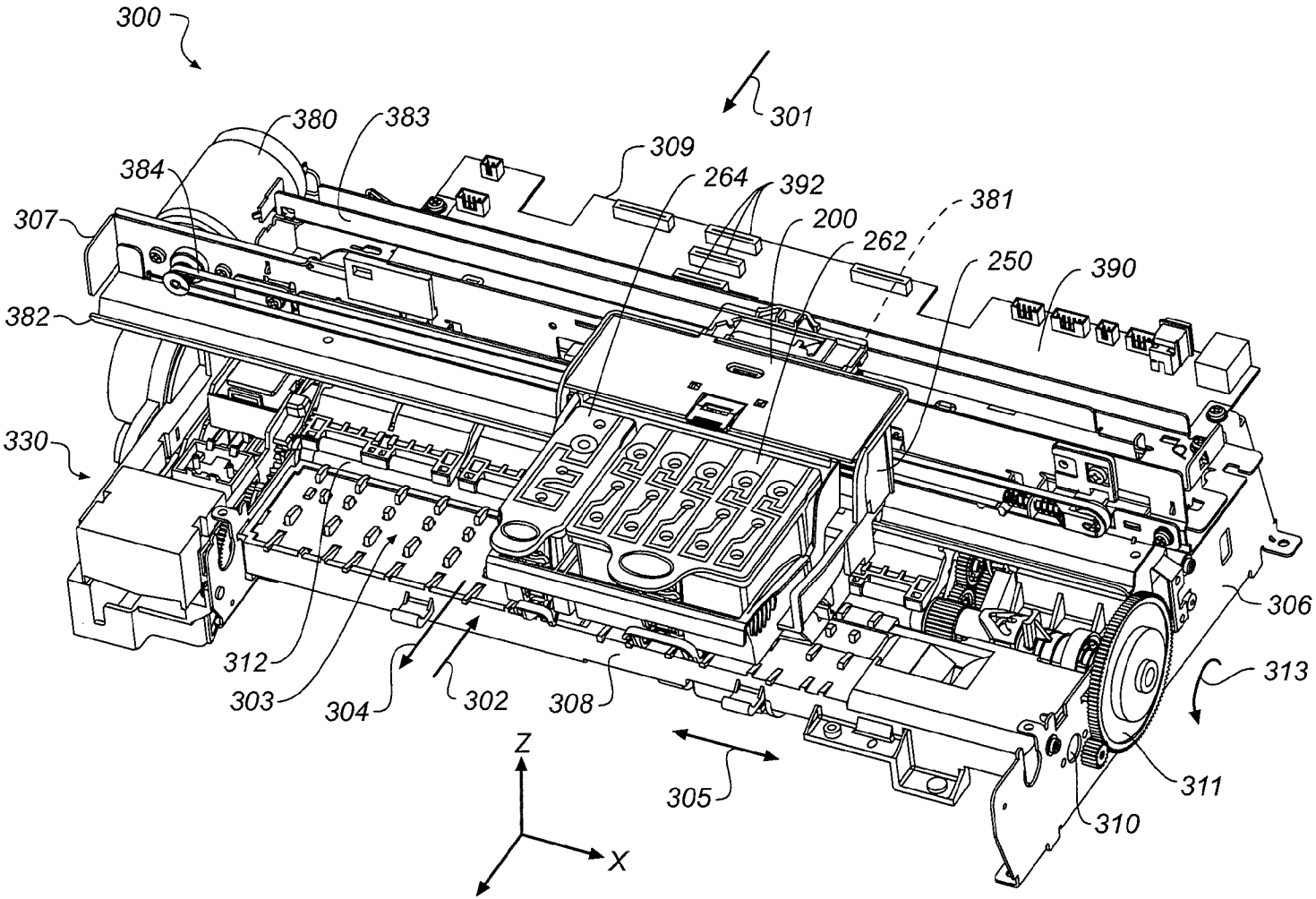
FIG. 3 is a perspective view of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead chassis 250 that is mounted on carriage 200. Carriage motor 380 moves belt 384 to move carriage 200 along carriage guide rail 382. An encoder sensor 381 is mounted on carriage 200 and indicates carriage location relative to an encoder fence 383 (also called a linear encoder herein). It is noted that although the present invention uses a linear encoder other suitable devices may be used, such as a monitor, which may include a linear encoder but is not limited to a linear encoder, for tracking the position of the carriage. In other words, during times when the carriage 200 is moving in the carriage scan direction 305 and the recording medium is not moving, the relative position of the carriage 200 and the recording medium is directly monitored. Likewise, the position of components affixed to carriage 200 (including the sensor 425 described below) relative to the recording medium are also directly monitored by use of encoder sensor 381 and encoder fence 383 when the recording medium is not moving.

Printhead chassis 250 is mounted in carriage 200, and multi-chamber ink supply 262 and single-chamber ink supply 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording medium in print region 303 in the view of FIG. 3. Multi-chamber ink supply 262, for example, contains five ink sources: a clear protective fluid as well as black, cyan, magenta, and yellow ink; while single-chamber ink supply 264 contains the ink source for black text. For a C-shaped paper path, paper or other recording medium is loaded along paper load entry direction 302 toward the front of printer chassis 308. In a C-shaped paper path, the print media is loaded into a paper with the backside (i.e. the non-printing side) of the media facing outward, so that sensing of a bar code on the backside using reflected light is straightforward. In an L-shaped paper (described below), the paper would be loaded nearly vertically at the rear 309 of the printer chassis along paper load entry direction 301.

The print region 303 is defined as the region toward which ink drops are ejected along the pathway of the carriage 200 as it moves printhead 250 in its carriage scan direction 305. A platen 400 (see FIG. 4) supports the recording medium as it is moved through the printing region 303. In many printers, particularly those that are configured to print borderless prints of photographic images, for example, absorbent material 420 spans a predetermined length of the platen 400. The absorbent material 420 functions as a collector for absorbing ink mist or oversprayed ink present in the print region 303. Platen 400 can include a plurality of support ribs 405 that protrude through the absorbent material 400 for providing a surface on which the paper rests during printing and during scanning of the paper type. As defined herein, "media support" means a support structure which functions primarily or entirely to support a print medium, such as paper and the like, during a stage of printing. The support ribs 405 are preferably disposed in a plurality of rows at predetermined locations relative to standard widths of print media, so that during borderless printing, ink that is oversprayed beyond the edges of the print medium lands primarily on absorbent material 420, rather than on the support ribs 405. The upper surfaces of the support ribs (e.g. media support surface 406 shown in FIG. 12) define a surface across which print medium is supported.

Figure 4:
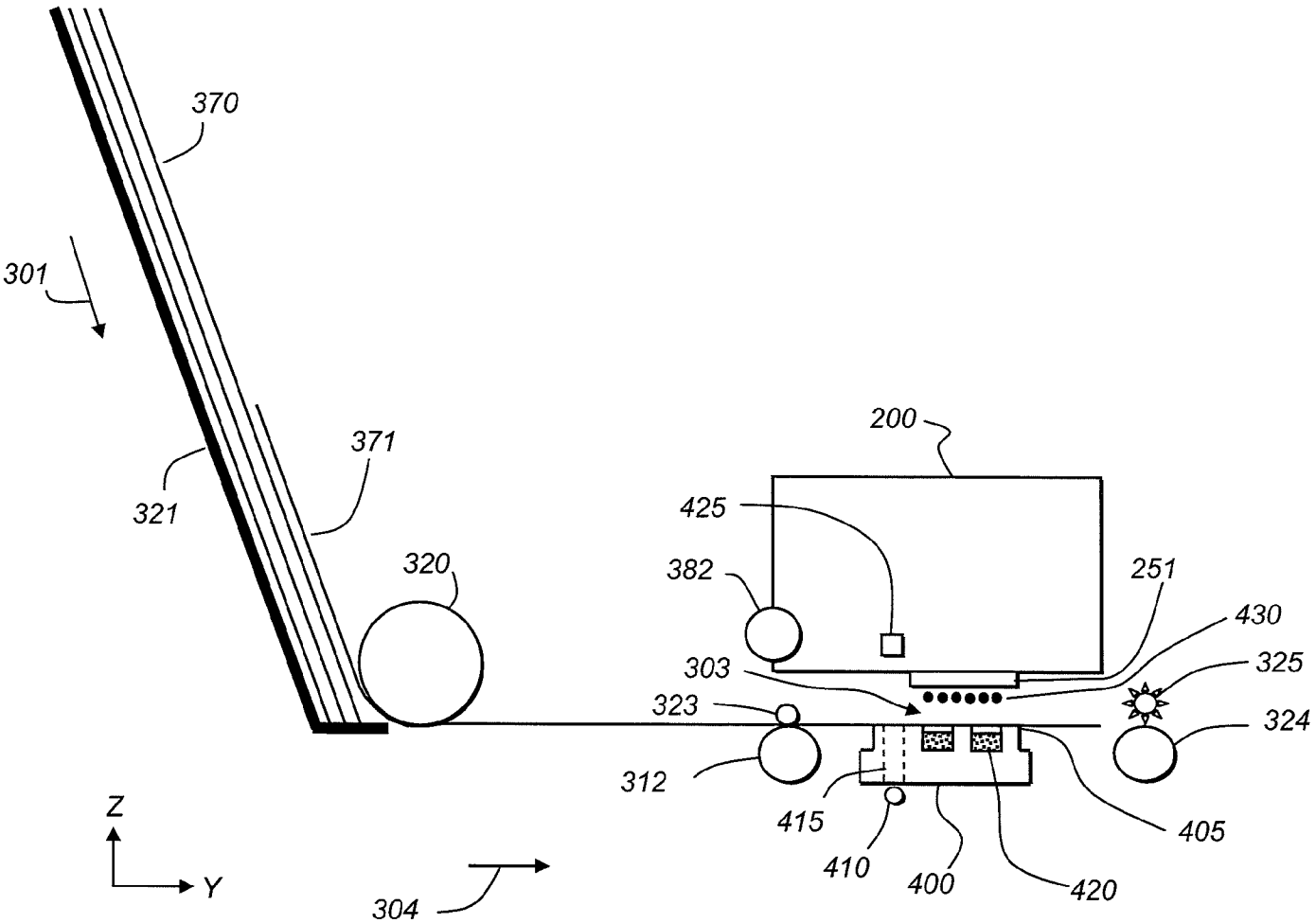
FIG. 4 is a block diagram illustrating the flow of the print media through the printing process of an L-shaped paper path.

A variety of rollers are used to advance the medium through the printer as shown schematically in the side view of the L-shaped paper path of FIG. 4. The L shape is defined by the relationship of media input support 321 and the paper path including media advance direction 304. In this example, a pick-up roller 320 moves the first piece or sheet 371 of a stack 370 of paper or other recording medium in media input support 321 from paper load entry direction 301 to the direction of arrow, media advance direction 304. The paper is then moved by feed roller 312 and idler roller(s) 323 to advance along the print region 303, and from there to a discharge roller 324 and star wheel(s) 325 so that printed paper exits along media advance direction 302. Feed roller 312 includes a feed roller shaft along its axis, and feed roller gear 311 (see FIG. 3) is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller, which indirectly indicates the position of the sheet 371 of media as it is being advanced. The position of sheet 371 is ascertained from the reading of the rotary encoder, assuming a nominal diameter of the roller, and assuming that the sheet moves without slippage relative to the roller. These assumptions are approximate, but not strictly accurate. Furthermore, while sheet 371 is being advanced by the pick-up roller 320, before sheet 371 reaches feed roller 312, it can be even more susceptible to slippage. For prior art media type identification systems that sense a bar code during the period of time when the sheet 371 is being advanced by the pick-up roller 320, measured distances between bar code features can sometimes be in error.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). A drive train or belt, for example, can be provided between feed roller gear 311 and pick-up roller 320 to drive pick-up roller 320 when needed. For normal paper pick-up and feeding, it is desired that the feed roller 320 and discharge roller 324 rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics (shown schematically as controller 14, memory 21 and image processing unit 15 in FIG. 1) for controlling the printing process, and an optional connector for a cable to a host computer.

Referring to FIG. 4, a platen 400 forms a structure in which the absorbent material 420 is disposed. It is noted that the paper path is L-shaped or substantially L-shaped as opposed to a C-shaped paper path. Light source(s) 410 are disposed below platen 400 for illuminating the piece of media 371 as it passes below carriage 200. Light passes through slot 415 in platen 400. When the media 371 is below carriage 200, the light passes through the piece of media 371 and into a light sensing device 425, which is attached to the carriage 200 (and aligned with slot 415), for sensing the light transmitted through the piece of media 371. In other words, light source 410 is on a first side of the surface defined by the media support and the carriage is on the opposite side of that defined surface. A media identification code, such as a bar code or the like, is disposed on the non-print side of the media 371 (the surface facing the light source) so that the media 371 can be identified via the transmitted light which is sensed by the light sensing device 425. During printing, the carriage 200 traverses back and forth across the print region 303 via a carriage guide rail 382 to position printhead die 251 to eject the ink drops 430 for printing onto the printing surface (surface facing the carriage 200) of the media 371 at precise locations determined by the image data and the position of the carriage determined from the encoder signals from encoder fence 383 (see FIG. 3). During a prior step of media identification, the carriage 200 is guided by carriage guide rail 382 to permit the light sensing device 425 to sense the transmitted light including the bar code pattern, while the relative position of the light sensing device 425 (being mounted on the carriage 200), is directly tracked or monitored by encoder sensor 381 and encoder fence 383, as described above relative to FIG. 3. In this manner, the printer is able to identify the particular type of media being used so that controller 14 and image processing unit 15 can make any adjustments suitable for that particular media prior to printing. Light source 410 is positioned at the bottom of the platen 400 and laterally displaced from print region 303 in order to reduce the amount of ink mist that collects on the light source 410, as described in more detail below.

In some embodiments, the carriage-mounted light sensing device 425 that is used to sense light transmitted through the sheet of media 371 for the purpose of identifying the type of media can also be used for other functions as well. US Patent Application Publication 2009/0213165, incorporated herein by reference, discloses a carriage-mounted sensor that can be used for functions including detecting malfunctioning ink jet nozzles, measuring printhead alignment, and characterizing media surface reflections. Such a carriage-mounted sensor can also be used as light sensing device 425 (also sometimes called a photosensor herein) to sense light transmitted through the sheet of media 371 for the purpose of identifying the type of media. By using a single sensor for multiple functions in a printing system, cost savings can be realized.

Figure 5B:
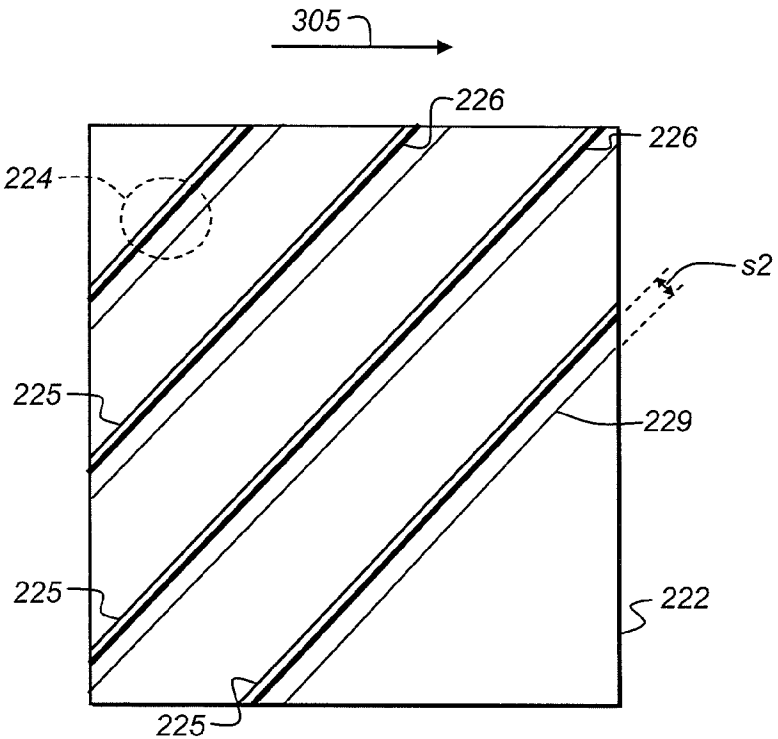
FIGS. 5A and 5B illustrate two different types of print media with correspondingly different bar codes for media type identification.
Figure 5A:
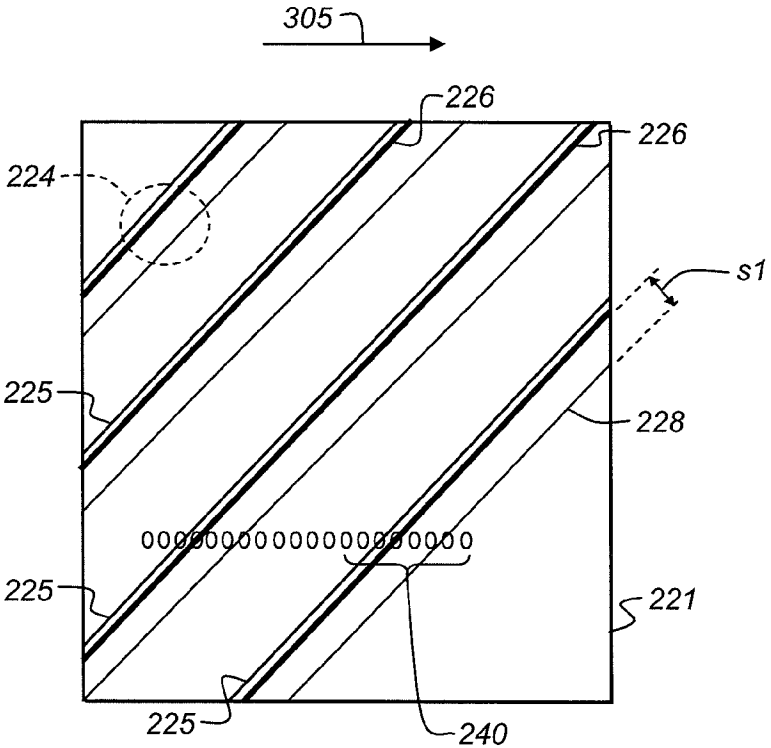

FIGS. 5A and 5B show schematic representation of markings on the backside of a first type of recording medium and a second type of recording medium respectively. In this embodiment, each of the various types of recording media has a reference marking consisting of a pair of "anchor bars" 225 and 226 which are located at a fixed distance with respect to one another for all media types. In addition, there is a first identification mark 228 on the first media type 221 in FIG. 5A, and there is a second identification mark 229 on the second media type 222 in FIG. 5B. In this example, first identification mark 228 is spaced a distance s1 away from anchor bar 226 on first media type 221, and second identification mark 229 is spaced a distance s2 away from anchor bar 226 on second media type 229, such that s1 does not equal s2. Thus in this example, it is the spacing of the identification mark from one of the anchor bars that identifies the particular type of recording medium. Anchor bars 225 and 226 plus identification mark 228 or 229 are collectively called a bar code pattern 224 herein.

Successive fields of view 240 of light sensing device 425, as carriage 200 is scanned relative to media type 221 along carriage scan direction 305, are schematically represented as ovals in FIG. 5A. Because the field of view 240 of the light sensing device 425 moves along the carriage scan direction 305 as the carriage 200 moves, it is actually the projections of marking spacings s1 and s2 along carriage scan direction 305 that are measured. The actual field of view 240 of light sensing device 425 can be a different size or shape other than the ovals shown in FIG. 5A, as determined, for example by aperture shape, the angle of the aperture plane relative to the plane of the recording medium, optical elements such as lenses, and optical path lengths. Photosensor data is actually sampled much more frequently than the ovals representing field of view 240 in FIG. 5A show, but only a few samples are shown for clarity. The size of the field of view is typically on the order of 1.5 mm (0.060 inch). In an example where the carriage moves at 20 inches per second and the sampling frequency is 20 kHz, the light sensing device 425 and its field of view 240 would move by 0.001 inch between successive samplings of the data.

The photosensor output signal can be amplified and filtered to reduce background noise and then digitized in an analog to digital converter. Once the amplified photosensor signal has been digitized, digital signal processing can be used to further enhance the signal relative to high frequency background noise. In addition, the signal can be converted into spatial distances (using position information from the linear encoder, for example) to find peak widths or distances between peaks corresponding to the code pattern markings. Digitized signal patterns are sent to processing electronics (for example a processor in controller 14 of FIG. 1) and compared to signal patterns stored in memory 21 to indicate media type. Examples of signal processing of bar codes for media type identification are disclosed in co-pending US Patent Application Publication 2009/0231403, which is incorporated herein in its entirety by reference.

In the examples shown in FIGS. 5A and 5B, the bar codes extend across the recording medium and are repeated a plurality of times on the recording medium. This configuration can be advantageous for the manufacturer of the recording medium in that recording media is typically manufactured in large rolls that are subsequently cut to size. If the bar code extends as in FIGS. 5A and 5B, it can be applied while the recording medium is still in the large roll format, and cut to whatever size is required. Smaller bar codes that are positioned with respect to a particular edge or corner of the recording medium are not as easily provided.

Figure 6:
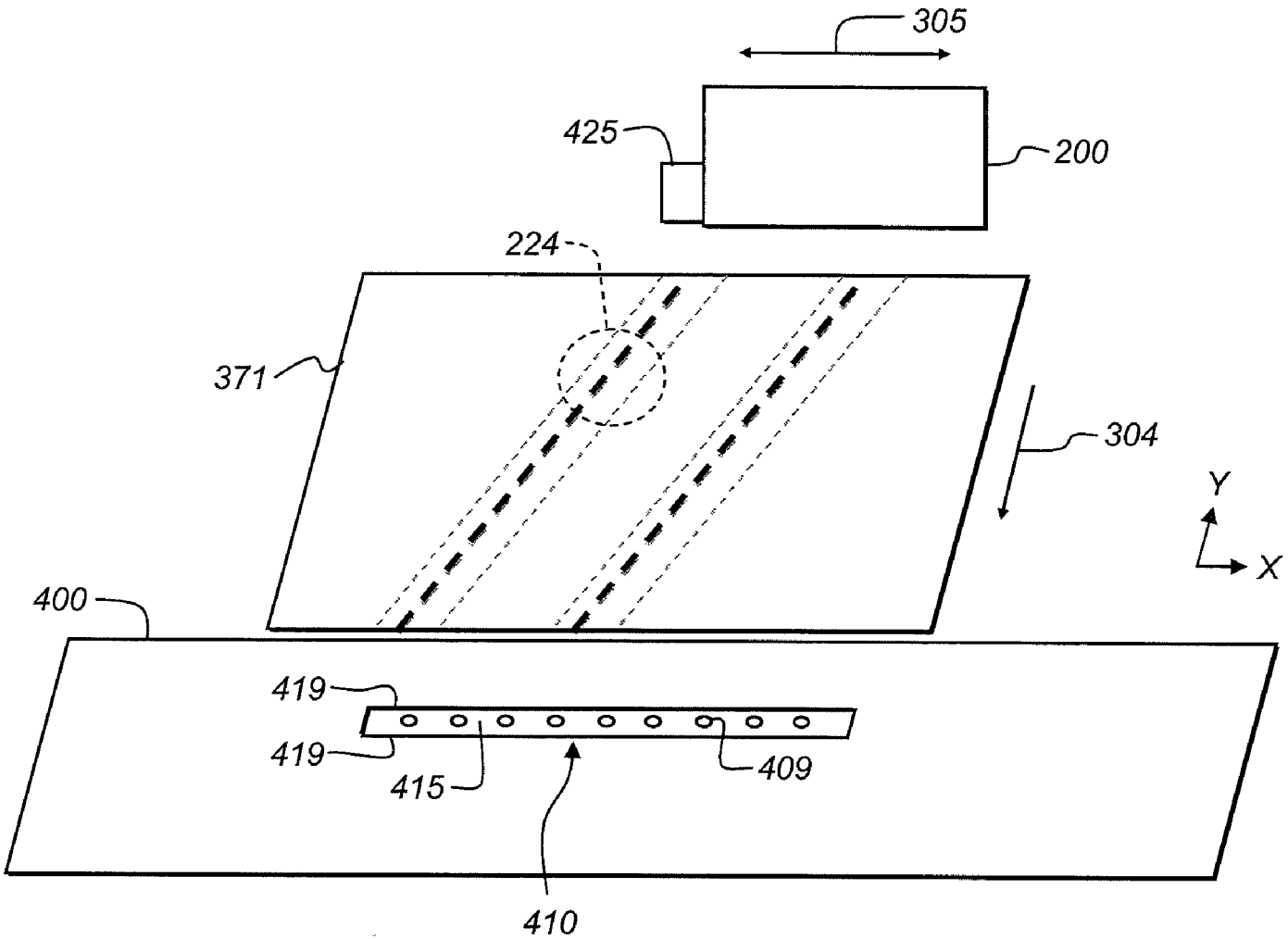
FIG. 6 is a schematic view of an array of spaced light emitters providing light through a slot in a platen for identification of media type.

It can be appreciated from the field of view ovals 240 in FIG. 5A that it is preferable that the transmitted light from light source(s) 410 (see FIG. 4) extend across a region of around two inches or more along a direction that is substantially parallel to carriage scan direction 305. One alternative would be to use a relatively large light source 410 having a field of illumination extending along carriage scan direction 305. In other alternatives, a plurality of smaller light emitters 409 (see FIG. 6), such as infrared light emitting diodes, can be positioned to provide a sufficiently large field of illumination on the media that rests on the media support. Such smaller light emitters 409 can be advantageous in that they can be compactly fit below the platen 400. Because the light from a small light source falls off in intensity as it spreads out further from the light source, it can be advantageous to have several light emitters 409 in order to provide a substantially uniform illumination in the region of interest, as is discussed further below. FIG. 6 schematically shows a linear array of nine light emitters 409 (such as infrared LED's) that provide illumination through a slot 415 in platen 400. Two of the slot walls 419 extend substantially parallel to carriage scan direction 305. The region of illuminated slot 415 extends across two repeating bar code patterns 224 of a piece of recording medium 371. (Bar code patterns 224 are shown as dashed lines in FIG. 6 because they are on the bottom side of recording medium 371 facing platen 400, rather than facing upward toward the viewer.) The linear array of light emitters 409 and slot 415 extend along carriage scan direction 305, so that as carriage 200 is moved along carriage scan direction 305, light sensing device 425 receives light emitted from the linear array of light emitters 409.

Figure 7A:
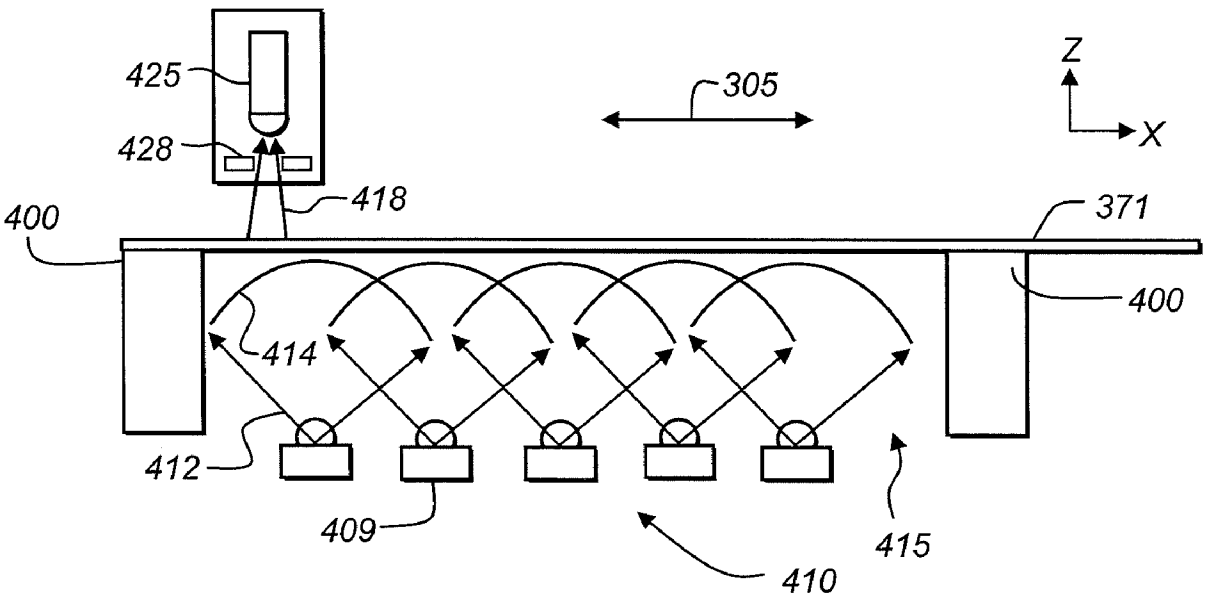
FIG. 7A is a schematic side view of an array of five spaced light emitters providing light through a slot in a platen for transmission through media to a moving light sensor on a carriage.
Figure 7B:
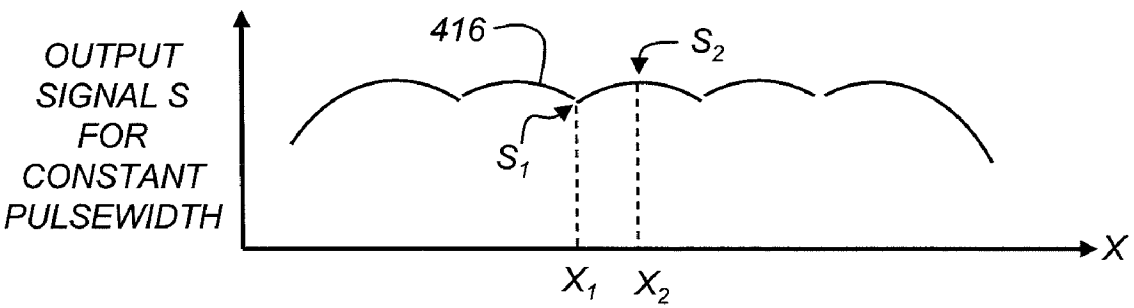
FIG. 7B schematically shows a reference baseline signal corresponding to the composite field of illumination from the five light emitters of FIG. 7A as a function of position of the moving light sensor.

FIG. 7A schematically shows a side view of an array of five spaced light emitters 409 (such as infrared LED's) that provide emitted light 412 through a slot 415 in a media support surface provided by platen 400. Each light emitter 409 has a field of illumination 414 that falls off in intensity as a function of distance from the light emitter. The light strikes a piece of print medium 371 that is supported by the platen 400. Light is diffused within print medium 371, and transmitted light 418 passes through aperture 428 that is positioned in front of movable light sensing device 425 that is attached to the carriage (which is not shown in FIG. 7A). Light sensing device 425 is moved by the carriage along carriage scan direction 305 (the X axis). In this side view, the Z axis is perpendicular to the sheet of print medium 371. FIG. 7B schematically shows a reference baseline signal 416 from light sensing device 425 corresponding to the composite field of illumination from the five light emitters 409 as a function of position along the X axis after the light is transmitted through an unmarked print medium 371 (i.e. no manufacturer's codes) and diffused in the process of passing through print medium 371. As can be seen, the light intensity of the field of illumination is nonuniform spatially, as it increases near each light emitter 409 and decreases between light emitters. For a composite field of illumination (as measured by reference baseline signal 416 of light sensing device 425) that is too nonuniform, the changes in transmitted light 418 received by light sensing device 425 that are due to light absorption by manufacturer's markings such as bar code 224 (see FIGS. 5A, 5B and 6) can be difficult to interpret. What is needed is a substantially constant illumination at the field of view of moving light sensing device 425, so that the manufacturer's code markings can be more readily distinguished and identified.

Figure 8:
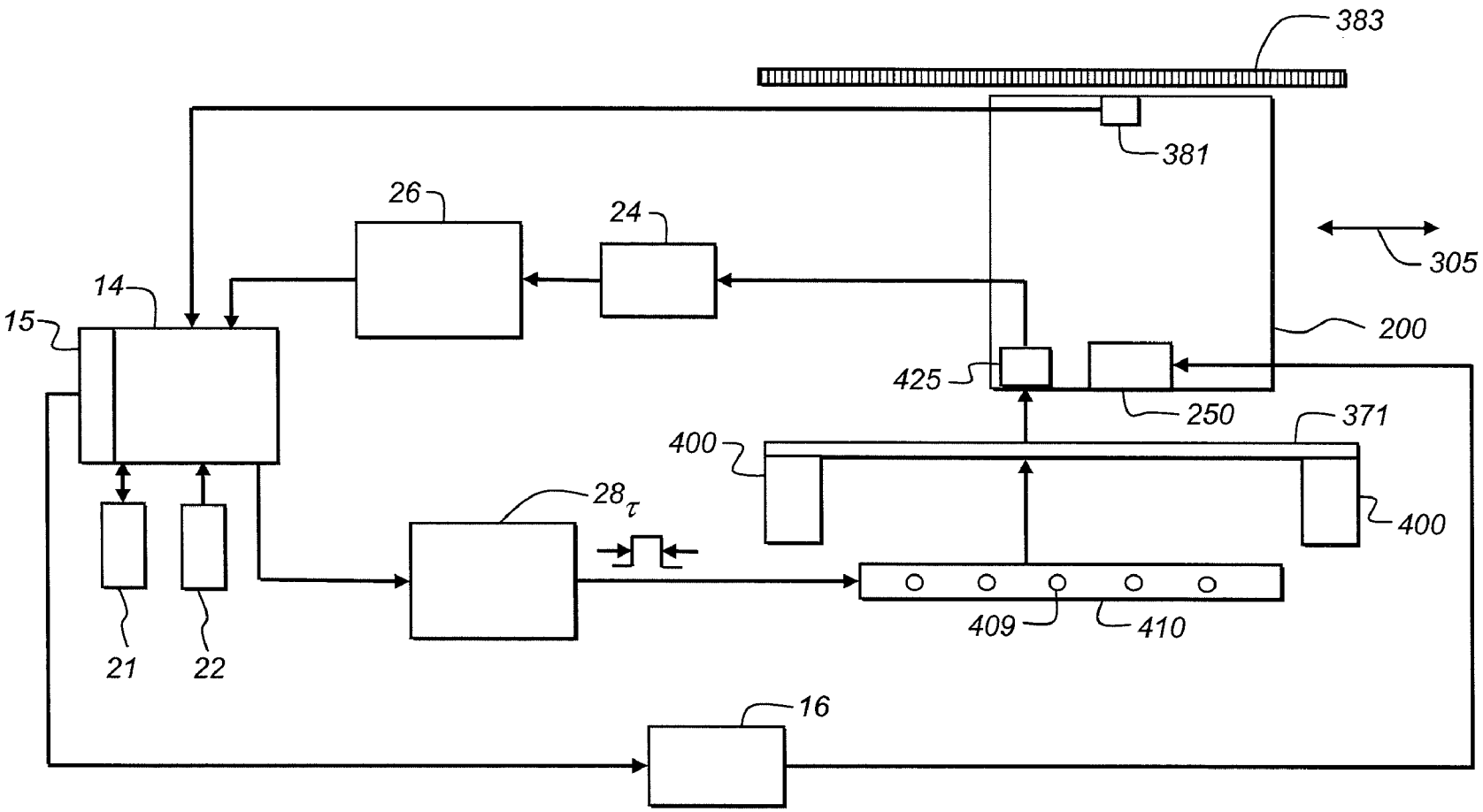
FIG. 8 is a schematic view of an inkjet printer that can provide uniform illumination to a moving light source from a spatially nonuniform field of illumination according to an embodiment of the invention.

Embodiments of the present invention determine an energy profile that can be used with an adjustable energy supply for the spatially nonuniform light source 410 in order to provide substantially uniform illumination to the field of view of light sensing device 425 as a function of the relative position of the light sensing device 425 and the light source 410. An example is schematically shown in FIG. 8 for providing uniform illumination to a light sensing device 425 mounted on a carriage 200 of a printer in order to identify a type of printing medium 371. In the example of FIG. 8, a stationarily mounted array of five spaced apart light emitters 409, disposed substantially along a straight line that is substantially parallel to the carriage scan direction 305, directs a spatially nonuniform field of illumination toward a media support surface of platen 400. The light emitters 409 (for example, infrared LED's) are powered by an adjustable energy source, which can be a pulse width modulator 28 providing voltage pulses of pulsewidth $\tau$, for example. A piece of printing medium 371 can be located on the media support surface of platen 400, and light can be transmitted through the piece of printing medium 371. A light sensing device 425 is mounted on a carriage 200 that can be moved back and forth along carriage scan direction 305. Also mounted on carriage 200 are encoder sensor 381 and printhead 250. An encoder fence 383 is positioned along the carriage scan path, and signals from encoder sensor 381 are sent to controller 14 to monitor where the carriage 200 and its various components are located along the carriage scan path. Light that enters the field of view of light sensing device 425 is converted to an electrical signal which is amplified in amplifier 24, converted to digital data by analog to digital converter 26, and sent to controller 14, thereby providing a measured signal from the light sensing device 425 as a function of relative position of light sensing device 425 and light source 410. Amplifier 24 and analog to digital converter 26 are used to process the electrical signal from light sensing device 425. An energy profile of pulsewidth versus relative position of light sensing device 425 and light source 410 along the carriage scan path can be determined and stored in memory 21. It can subsequently be used by controller 14 to control pulse width modulator 28 in a time-varying sense so that the light output of light emitters 409 is increased or decreased to compensate for spatial nonuniformity of the composite field of illumination of light emitters 409, thereby providing a substantially constant illumination to the field of view of the moving light sensing device 425. If a piece of printing medium 371 includes manufacturer's code markings (made for example with IR-absorbent ink), the decrease in signal of light sensing device 425 is thereby more clearly distinguished from changes in the spatially nonuniform illumination from the light emitters 409.

In order to determine a suitable energy profile as a function of position of the light sensing device 425, an initial calibration can be performed, either by the manufacturer, or at the user's site on an as-needed basis. For example, the light emitters 409 can be powered at constant energy (i.e. constant pulse width from pulse width modulator 28) either with or without a piece of unmarked print medium 371 on the media support surface of platen 400 in order to provide a reference baseline signal 416 as a function of position of light sensing device 425 along the carriage scan path. It has been found that a spatially nonuniform composite field of illumination can be compensated for by adjusting the pulse width to be substantially inversely proportional to the reference baseline signal at a given position. For example, suppose the pulse width $\tau_1$ corresponded to a desired nominal illumination as indicated by the reference baseline signal $S_1$ at a position $X_1$ of light sensing device 425 (see FIG. 7B). If at position $X_2$ the reference baseline signal 416 is $S_2=cS_1$, then the pulse width at position $X_2$ would be set to $\tau_2\sim\tau_1/c$. The output signal from a light sensing device 425 that receives light during an interval of time is proportional to the number of photons that hit the light sensing device during that time interval. Therefore if the spatially nonuniform composite field of illumination provides relatively fewer photons to light sensing device 425 at position $X_1$ as compared to position $X_2$, the duration of time that the light source 410 is on can be increased accordingly by increasing pulsewidth $\tau$ at position $X_1$. One reason for the approximation in the expression $\tau_2\sim\tau_1/c$ is that light sensing device 425 is moving during the pulsing time interval. For a field of illumination that is rapidly changing along the carriage scan direction 305 (i.e. along the X direction), there can be a deviation from $\tau_2=\tau_1/c$ in order to produce a uniform output signal from light sensing device 425. If the pulsing frequency for light emitters 409 is 20 KHz and the maximum pulsewidth i is 1% of the 50 microsecond period, and if the carriage 200 is moving at 20 inches per second, then the field of view of light sensing device 425 moves a maximum of 0.00001 inch during an on pulse. In an application where the light emitters 409 are small IR LED's that are spaced apart on 18 mm centers (0.709 inch), the approximation $\tau_2\sim\tau_1/c$ is typically pretty good.

An energy profile consisting of pulsewidth $\tau$ versus position X of the light sensing device 425 can thus be determined and stored in memory 21. In some embodiments the energy profile data can be entirely empirically determined. In other embodiments the reference baseline signal 416 can be fit to a curve and the energy profile can be calculated as a function of position of the light sensing device. For example, the radiant intensity of an isolated small LED light source can vary as the cosine of the angle between the normal to the LED and the point at which light is sensed. In some embodiments, the illumination after diffuse reflections can vary approximately as the cosine squared.

Figure 9:
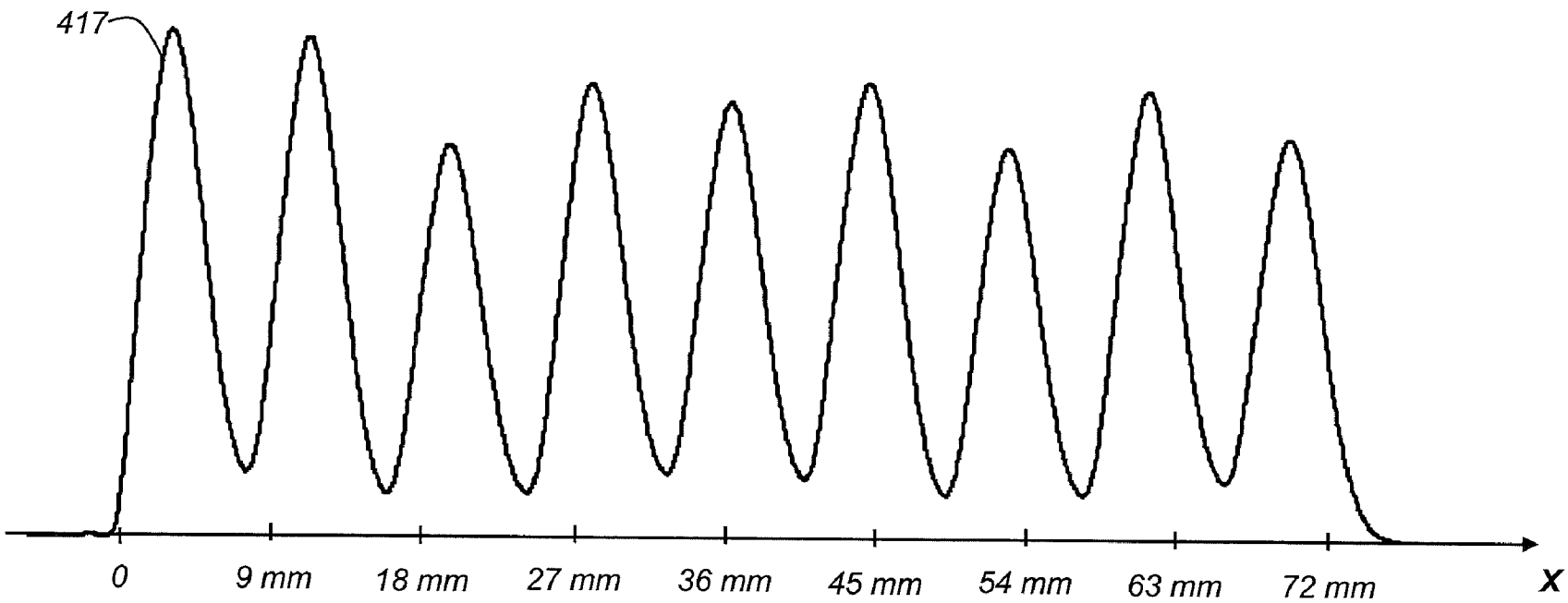
FIG. 9 is an output signal from a moving light sensing device corresponding to the illumination as a function of position from a linear array of nine LED's.

A light source having a linear array of nine infrared LED's (each approximately 1.2 mm in diameter and substantially uniformly spaced on approximately 9 mm centers between adjacent LED's, for an end-to-end LED spacing of 72 mm) was assembled onto a printed circuit board having power leads connected in parallel so that the same pulse width was provided to each of the nine LED's, i.e. that the energy is changed to all the LED's in the array by the same amount at the same time. FIG. 9 shows the output signal 417 of the light sensing device 425 during a calibration scan at constant pulsewidth over the nine LED's with no paper or other diffusing medium between the light source 410 and the light sensing device 425. Light sensing device 425 was approximately 11 mm above the array of LED's. The peaks of the output signal 417 are well-resolved from one another and occur at locations that are 9 mm apart, corresponding to locations where the light sensing device 425 is directly over the individual LED's. Note that between adjacent LED's, output signal 417 does not go to zero because there is overlap of radiant light when the LED's are at 9 mm spacing. The amount of overlap of light depends on the output angle of illumination of the LED, as well as the relationship of the spacing between LED's to the distance from the light sensing device 425 to the array of light emitters 409. Note also that the peaks are not all at the same amplitude. This can be due to manufacturing variability of the LED's, for example.

Figure 10:
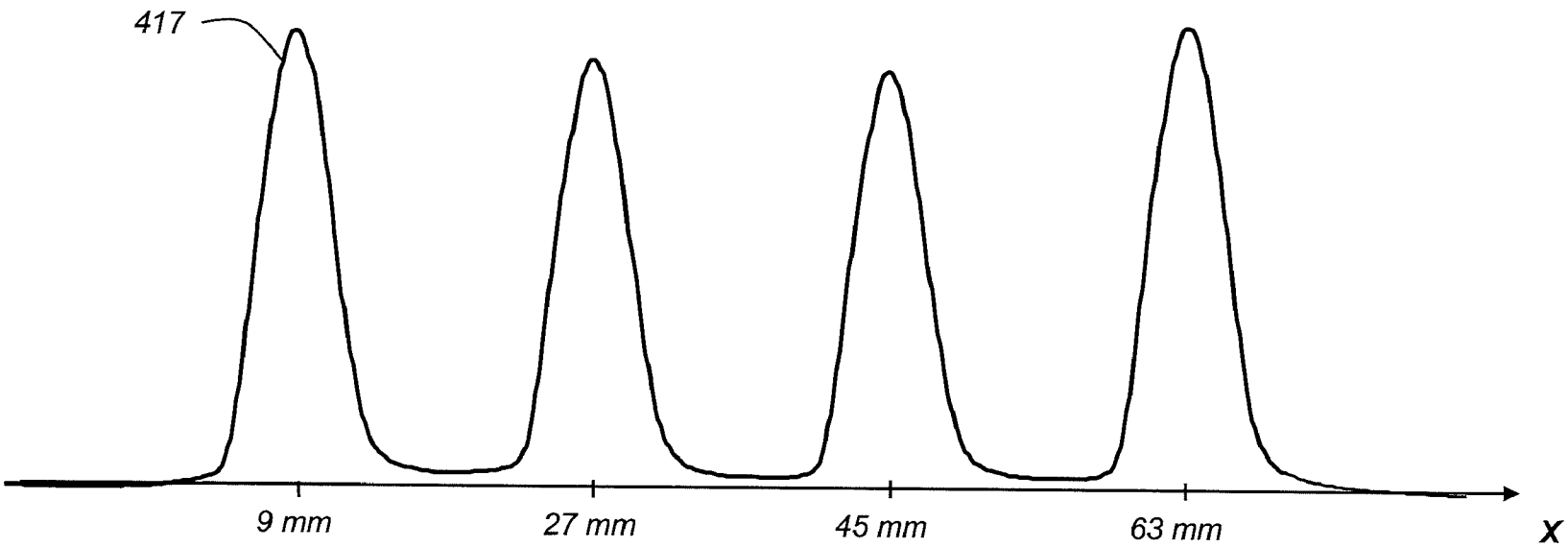
FIG. 10 is an output signal from a moving light sensing device corresponding to the illumination as a function of position from a linear array of four of the nine LED's of FIG. 9.

In order to see the effect of having fewer LED's at increased spacing (with the light sensing device 425 still at a distance of about 11 mm from the array of light emitters 409), a calibration scan was also run (FIG. 10) where the light was obstructed for the first, third, fifth, seventh and ninth LED of the linear array of LED's. In this calibration scan of FIG. 10, the LED's providing light were the second, fourth, sixth and eighth LED's of the array. Thus the illuminating LED's were spaced approximately 18 mm apart, with an end-to-end LED spacing of 54 mm (i.e. 63 mm-9 mm). Output signal 417 for four LED's spaced by approximately 18 mm goes nearly to zero midway between the peaks for a light sensing device spaced about 11 mm from the array of light sources.

Figure 11:
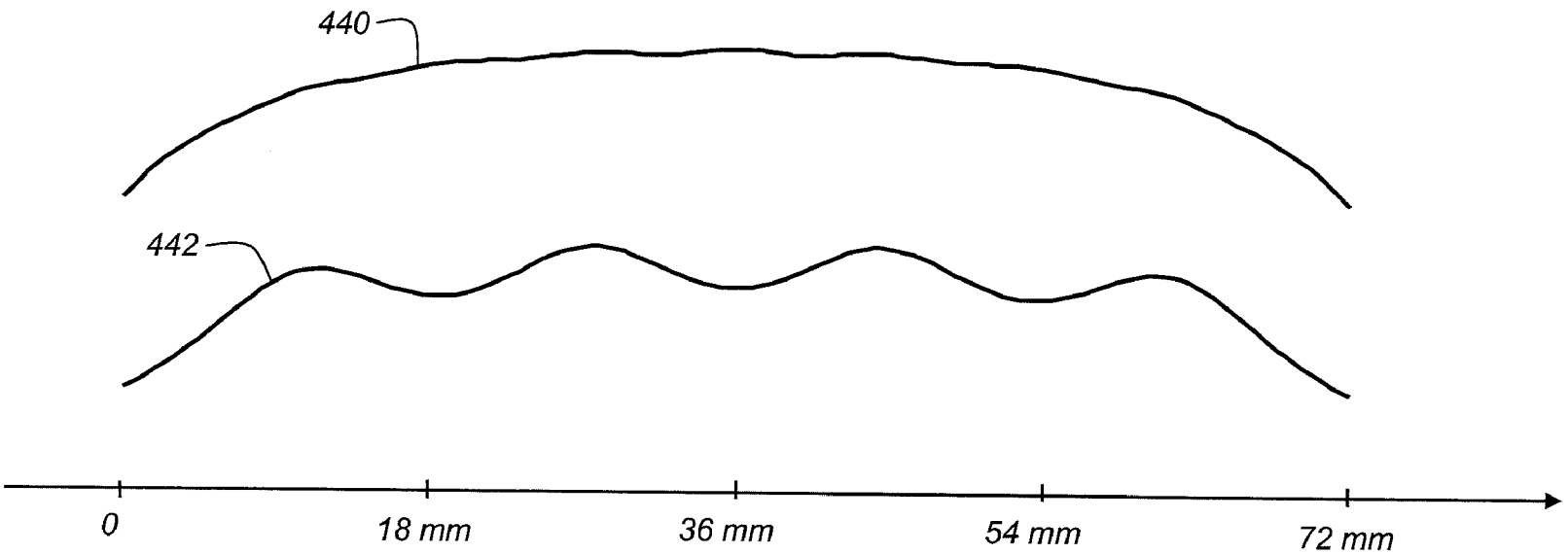
FIG. 11 shows output signals from a moving light sensing device corresponding to the illumination as a function of position from linear arrays of four and nine LED's where the light has been diffused by unmarked paper.

With an unmarked piece of paper located between the linear array of light emitters 409 and light sensing device 425, the output signal for constant pulsewidth is much more smoothly varying (due to diffusion in the paper) as seen in FIG. 11. Output curve 440 corresponds to nine illuminating LED's spaced at 9 mm with an end-to-end spacing of 72 mm. Output curve 442 corresponds to four illuminating LED's spaced at 18 mm with an end-to-end spacing of 54 mm. It has been found in some applications that the composite field of illumination of nine LED's spaced at 9 mm (curve 440) has sufficient uniformity, amplitude and extent—even at constant pulsewidth powering the LED's—for satisfactorily identifying different barcode patterns to correctly identify different types of recording media. However, it is possible to reduce the cost by using fewer LED's. It has been found that determining and using a suitable energy profile of pulsewidth versus position of light sensing device 425, an array of five LED's spaced at 18 mm with an end-to-end spacing of 72 mm has sufficient uniformity, amplitude, and extent for reliably identifying different barcode patterns, even with the distance (~11 mm) between the light sensing device 425 and the array of light emitters 409 being less than the spacing (~18 mm) between adjacent light sources. The elimination of four LED's provides a savings of 44% in LED's relative to the nine LED linear array of light sources.

With reference again to FIG. 8, after the determined energy profile has been stored in memory 21, the media type located at platen 400 can be correctly identified by controller 14 by comparing signal patterns from light sensing device 425 to media identification signal patterns stored in memory 22. As described above, the light output provided by spatially non-uniform light source 410 is adjusted as a function of the position of light sensing device 425 by pulsewidth modulator 28 according to the determined energy profile stored in memory 21 in order to provide sufficiently uniform illumination toward the field of view of moving light sensing device 425, so that the media type is reliably identified. The information regarding type of media can subsequently be used to select a print mode for image processing unit 15 to process the print data to control electrical pulse source 16 to provide pulses at the proper timing to printhead 250 on moving carriage 200 in order to print desired image on print medium 371.

For a light source 410 that is located in the region of the platen 400 of an inkjet printer as shown in FIGS. 4, 6, 7 and 8, it is advantageous to design the printer in such a way that sufficiently uniform illumination can be provided to light sensing device 425 over the life of the printer, even after ink mist from the inkjet printing process has built up on various surfaces of the printer over time. Such printer design features include providing periodic calibration of the field of illumination of light source 410 and modifying the determined energy profile stored in memory 21; and reducing the rate of ink mist build-up on the most critical surfaces of the optical pathway. Calibration of the field of illumination of light source 410 can be done as described above with reference to FIG. 8. However, in addition to variation of the peak amplitudes along the array of LED's in light source 410 due to manufacturing variability, as described above with reference to FIG. 9, ink mist build-up on the LED's and walls of slot 415 can also cause both a decrease and a nonuniform change in peak amplitudes of illumination. In the calibration run, a constant pulsewidth is provided to the LED's in light source 410 as carriage 200 moves light sensing device 425 along the carriage scan path and the output signal of the light sensing device is mapped out as a function of position. As described above, an energy profile is determined for adjusting the pulsewidth in pulsewidth modulator 28 to provide a sufficiently uniform illumination to the field of view of the light sensing device. This new energy profile is stored in memory 21 for subsequent use in identification of media type.

Reducing the rate of ink mist build-up on the most critical surfaces in the optical pathway can be done in several ways. One way is to position light source 410 in a recessed position relative to the media support at a location that is offset from print region 303 as shown in FIG. 4. A second way is to make slot 415 both narrow along the Y direction (i.e. parallel to media advance direction 304) and deep along the Z direction (i.e. parallel to the direction along which the printhead 250 is spaced apart from platen 400). Slot 415 is elongated (about 75 mm long) along the X direction (see FIGS. 6 and 7A) to provide light along carriage scan direction 305. A slot design in a portion of platen 400 is shown in more detail in the cross-sectional view of FIG. 12, which is viewed in the opposite sense from FIG. 4 relative to media advance direction 304. The depth D of slot 415 is approximately 9 to 10 mm from a first end near the media support surface 406 of support rib 405 to a second end near the array of light emitters 409 mounted on a printed circuit board 411. The width $W_1$ of slot 415 along the Y direction near light source 410 is approximately 1.4 mm (i.e. width $W_1$ of slot 415 is less that one quarter of the depth of the slot). The slot width $W_2$ near the media support surface 406 widens out to around 2 mm for reasons described below. The narrow and deep slot 415 causes some ink mist to collect on slot walls 419 before the mist can reach the more critical surface of light source 410. A further way that ink mist can be kept from reaching the critical surfaces of the optical pathway is to provide an ink mist attractor, such as an electrostatic member (not shown) to attract ink mist to itself.

Figure 12:
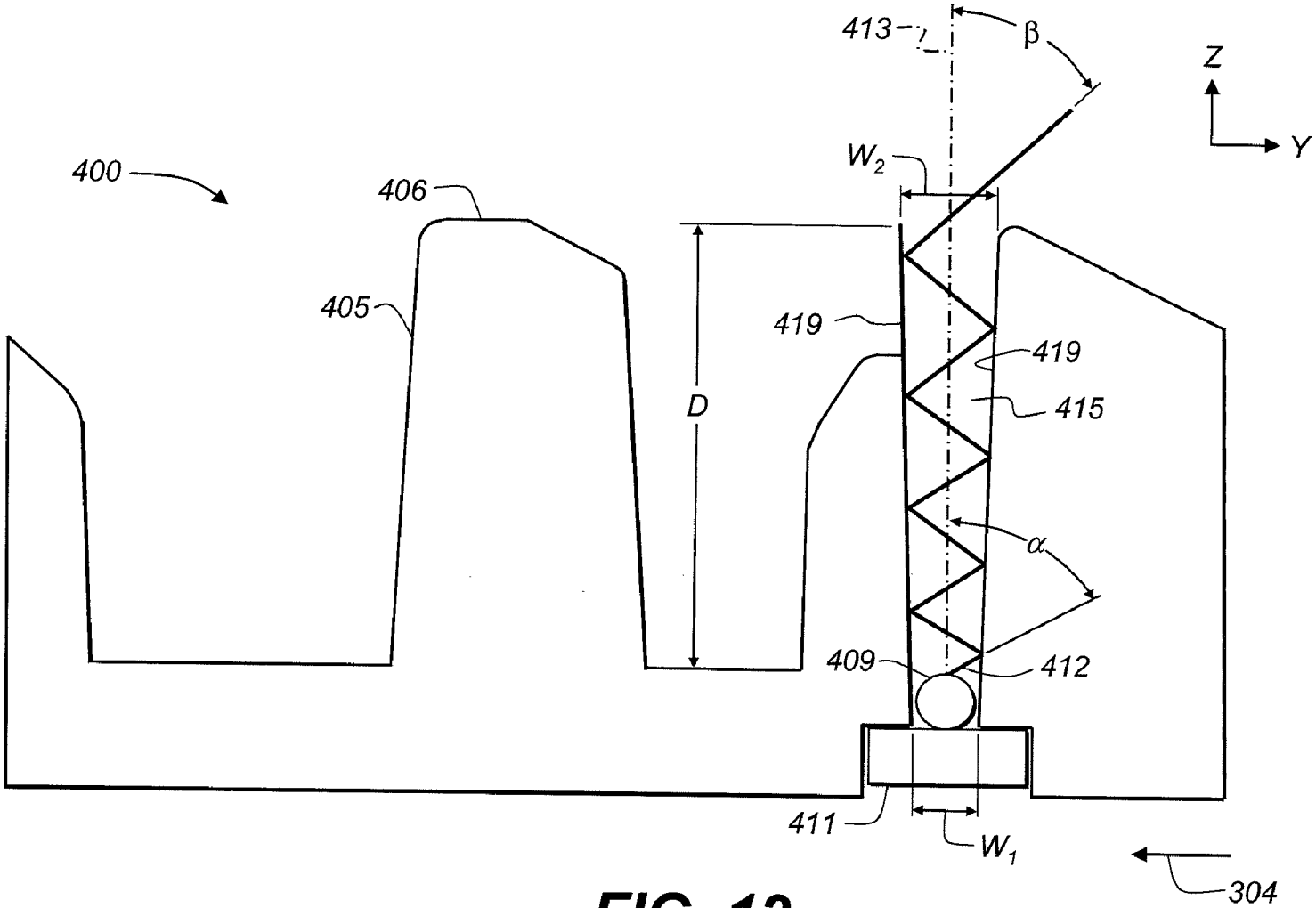
FIG. 12 is a cross-sectional view of portion of a platen with a light source positioned within a slot, according to an embodiment of the invention.

It is advantageous for slot walls 419 of platen 400 to incline outwardly from the bottom of the slot 415 to the top of the slot 415, so that slot width $W_2$ is greater than slot width $W_1$ for both manufacturing reasons and for optical efficiency. In other words, the two slot walls 419 are inclined relative to one another. Platen 400 is typically made in an injection molding process. To prevent molten plastic from flowing into the slot region during injection molding, a blade is inserted into the molding tool. The blade can be made more robust and be easier to withdraw from the slot after slot formation if it is narrower toward its tip end that determines the slot width $W_1$. The resulting wider base of slot walls 419 also helps to strengthen the slot walls. The improvement in optical efficiency can be understood relative to the ray of emitted light 412 shown in FIG. 12 before and after multiple reflections from inclined slot walls 419. Light is emitted from the LED's in light source 410 at an angle of up to 60 degrees from the normal 413 to the LED. It is desired to constrain the spread of the light such that it illuminates a region that is within the field of view of light sensing device 425 (see FIG. 7A) without too much light being wasted because it is outside the field of view. In FIG. 12, a ray of emitted light 412 is shown being emitted at a relatively large angle $\alpha$ relative to normal 413, where $\alpha$ is approximately 60 degrees. After multiple reflections from the inclined slot walls 419, the ray of emitted light 412 emerges from slot 415 at an angle $\beta$ (for example 50 degrees) which is less than $\alpha$. Thus the inclined slot walls 419 tend to concentrate the light so that less of it is wasted, thereby providing a greater signal to light sensing device 425 for the same number of LED's and the same pulsewidth. It is further advantageous if the slot walls 419 are specularly reflective with high reflectivity for at least a portion of the light spectrum (e.g. infrared) emitted by light emitters 409. This can be accomplished during the injection molding process if the blade surfaces have been polished to a smooth finish, so that the molded slot walls are very smooth. In some embodiments it is preferred that the molded slot walls have a root mean square (rms) surface roughness of less than 20 micro inches, and further preferred that the average rms surface roughness be less than 5 micro inches.

In summary, the present invention includes a method for providing uniform or substantially uniform illumination to a field of view of a light sensing device that is moving with respect to a light source, the method comprising the steps of (a) providing an inkjet printhead to eject ink for printing; (b) providing a monitor to track the position of the light sensing device relative to the light source; and (c) providing an energy supply that provides a time-varying energy as a function of the position of the light sensing device relative to the light source in a manner that provides substantially uniform illumination from the light source toward a field of view of the light sensing device.

The invention has been described in detail with particular reference to certain preferred embodiments thereof, but it will be understood that variations and modifications can be effected within the spirit and scope of the invention. In particular, although embodiments have been described relative to uniform illumination to a moving light sensing device for detecting manufacturer's codes to identify media type in an inkjet printer, the invention can be used for providing uniform illumination to a moving sensor for other types of printing systems, as well as for non-printing systems employing a sensor that is moved with respect to a spatially nonuniform field of illumination.

PARTS LIST

10 Inkjet printer system
12 Image data source
14 Controller
15 Image processing unit
16 Electrical pulse source
18 First fluid source
19 Second fluid source
20 Recording medium
21 Memory
22 Memory
24 Amplifier
26 Analog to digital converter
28 Pulse width modulator
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
221 First type recording medium
222 Second type recording medium
224 Bar code pattern
225 First bar of anchor bar pair
226 Second bar of anchor bar pair
228 Identification mark for first type recording medium
229 Identification mark for second type recording medium
240 Field of view
250 Printhead chassis
251 Printhead die
253 Nozzle array
254 Nozzle array direction
255 Mounting support member
256 Encapsulant
257 Flex circuit
258 Connector board
262 Multi-chamber ink supply
264 Single-chamber ink supply
300 Printer chassis
301 Paper load entry direction (for L path)
302 Paper load entry direction (for C path)
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
321 Media input support
323 Idler roller
324 Discharge roller
325 Star wheel(s)
330 Maintenance station
370 Stack of media
371 First piece of medium
380 Carriage motor
381 Encoder sensor
382 Carriage guide rail
383 Encoder fence
384 Belt
390 Printer electronics board
392 Cable connectors
400 Platen
405 Support ribs
406 Media support surface
409 Light emitter
410 Light source
411 Printed circuit board
412 Emitted light
413 Normal
414 Field of illumination
415 Slot
416 Reference baseline signal
417 Output signal
418 Transmitted light
419 Slot wall
420 Absorbent material,
425 Light sensing device
428 Aperture
430 Ink drops
440 Output curve (nine LED's spaced by 9 mm)
442 Output curve (four LED's spaced by 18 mm)

The invention claimed is:

1. A method for providing uniform or substantially uniform illumination to a field of view of a light sensing device that is moving with respect to a light source, the method comprising the steps of:

(a) providing an inkjet printhead to eject ink for printing;

(b) providing a monitor to track the position of the light sensing device relative to the light source; and (c) providing an energy supply that provides a time-varying energy as a function of the position of the light sensing device relative to the light source in a manner that provides substantially uniform illumination from the light source toward a field of view of the light sensing device.

2. The method according to claim 1 further comprising the steps of:

determining an energy profile for the energy supply; and storing the determined energy profile.

3. The method according to claim 2, wherein the step of determining an energy profile comprises measuring a signal from the light sensing device as a function of the relative position as the light sensing device is moved relative to the light source while the energy from the energy supply is kept constant or substantially constant.

4. The method according to claim 2 further comprising the steps of:

moving the light sensing device relative to the light source while tracking the relative position; and providing a time-varying energy from the energy supply to the light source according to the determined energy profile.

5. The method according to claim 4, wherein the light source comprises an array of spaced-apart light emitters.

6. The method according to claim 5, wherein the light emitters are disposed substantially along a straight line, and wherein the motion of the light sensing device relative to the array of light emitters is substantially parallel to the straight line.

7. The method according to claim 5, wherein the step of providing a time-varying energy to the array of light emitters further comprises changing the energy provided to all light emitters in the array by the same amount at the same time.

8. The method according to claim 5, wherein the step of providing a time-varying energy to the array of light emitters further comprises modulating the pulsewidth of electrical pulses provided to the light emitters in the array.

9. The method according to claim 5, wherein the light emitters in the array are light emitting diodes.

10. The method according to claim 5, the array of light emitters includes a spacing between adjacent light emitters in the array, wherein a distance between the light sensing device and the array of light emitters is less than the spacing between adjacent light emitters in the array.

11. The method according to claim 5, wherein the light sensing device is moved and the array of light emitters is held stationary.

12. The method according to claim 5, wherein a light diffusing element is provided between the array of light emitters and the light sensing device.

13. A method for identifying a patterned region on a print medium in a printing system, the method comprising the steps of:

(a) providing a media support defining a surface;

(b) providing a light source to emit light toward the defined surface;

(c) providing a carriage that is movable along a carriage scan direction, the carriage includes a light sensing device having a field of view that receives light emitted from the light source;

(d) providing an energy supply that provides a time-varying energy as a function of the position of the light sensing device relative to the light source in a manner that provides substantially uniform illumination from the light source toward a field of view of the light sensing device; and (e) providing a monitor to track a position of the carriage.

14. The method according to claim 13 further comprising the step of:

providing a controller and memory;

determining an energy profile for the energy supply;

storing the determined energy profile;

advancing the print medium onto the media support surface;

providing energy from the energy supply to the light source to provide illumination across a portion of the print medium;

moving the carriage along the carriage scan direction;

providing a time-varying energy from the energy supply to the light source according to the determined energy profile; and processing a signal from the light sensing device to identify the patterned region on the print medium.

15. The method according to claim 14, wherein the step of providing the monitor comprises the step of providing an encoder sensor on the carriage and providing a linear encoder disposed along the carriage scan direction.

16. The method according to claim 14, wherein the step of determining an energy profile comprises measuring a signal from the light sensing device as a function of the position of the carriage while the energy from the energy supply is kept constant or substantially constant.

17. The method according to claim 14, wherein the light source comprises an array of spaced-apart light emitters.

18. The method according to claim 17, wherein the array of light emitters is disposed substantially along a straight line that is substantially parallel to the carriage scan direction.

19. The method according to claim 17, wherein the step of providing the time-varying energy to the array of light emitters further comprises the step of changing the energy provided to all light emitters in the array by the same amount at the same time.

20. The method according to claim 17, wherein the step of providing the time-varying energy to the array of light emitters further comprises modulating the pulse width of electrical pulses provided to light emitters in the array.

21. The method according to claim 17, wherein the array of light emitters includes a spacing between adjacent light emitters in the array, wherein a distance between the light sensing device and the array of light emitters is less than the spacing between adjacent light emitters in the array.

22. The method according to claim 17, wherein the array of light emitters are disposed on a first side of the media support surface and the carriage is disposed on a second side of the media support surface, so that light emitted from the array of light emitters is transmitted through the print medium.

23. The method according to claim 14, further comprising the step of storing a plurality of identification patterns in memory, wherein the step of processing the signal to identify the patterned region on the print medium comprises the step of comparing the processed signal to the plurality of identification patterns stored in memory and selecting one of the plurality of identification patterns that corresponds to the processed signal.

24. The method according to claim 23, wherein the plurality of identification patterns correspond to different types of print media, the method further comprising the step of identifying a type of print media corresponding to the print medium that was advanced onto the media support surface.

* * * * *